US009899172B2

(12) United States Patent
Urai et al.

(10) Patent No.: US 9,899,172 B2
(45) Date of Patent: Feb. 20, 2018

(54) CIRCUIT BREAKER AND CIRCUIT BREAKER OPERATING METHOD

(71) Applicant: Hitachi, Ltd., Chiyoda-ku, Tokyo (JP)

(72) Inventors: Hajime Urai, Tokyo (JP); Yasuaki Aoyama, Tokyo (JP); Hiroaki Hashimoto, Tokyo (JP); Katsuhiko Shiraishi, Tokyo (JP); Tatsuro Kato, Tokyo (JP); Ayumu Morita, Tokyo (JP); Toshiaki Rokunohe, Tokyo (JP); Yoichi Oshita, Tokyo (JP)

(73) Assignee: Hitachi, Ltd., Tokyo (JP)

( * ) Notice: Subject to any disclaimer, the term of this patent is extended or adjusted under 35 U.S.C. 154(b) by 771 days.

(21) Appl. No.: 14/390,469

(22) PCT Filed: Mar. 27, 2013

(86) PCT No.: PCT/JP2013/058898
§ 371 (c)(1),
(2) Date: Oct. 3, 2014

(87) PCT Pub. No.: WO2013/150930
PCT Pub. Date: Oct. 10, 2013

(65) Prior Publication Data

US 2015/0043121 A1 Feb. 12, 2015

(30) Foreign Application Priority Data

Apr. 6, 2012 (JP) ..... 2012-086993

(51) Int. Cl.
*H01H 47/22* (2006.01)
*H01H 33/38* (2006.01)
(Continued)

(52) U.S. Cl.
CPC ..... *H01H 47/223* (2013.01); *H01H 33/36* (2013.01); *H01H 33/38* (2013.01);
(Continued)

(58) Field of Classification Search
CPC ..... H01H 3/268; H01H 3/28; H01H 33/38; H01H 47/223; H01H 75/10; H01H 3/36; H01H 3/38
See application file for complete search history.

(56) References Cited

U.S. PATENT DOCUMENTS 6,331,687 B1 * 12/2001 Dunk ..... H01H 11/0062 218/140
6,531,841 B1 3/2003 Elli et al.
(Continued)

FOREIGN PATENT DOCUMENTS

CN 1360729 A 7/2002
CN 200972840 Y 11/2007
(Continued)

OTHER PUBLICATIONS

Chinese-language Office Action issued in counterpart Chinese Application No. 201380017871.8 dated May 26, 2016 with English translation (Twenty-one (21) pages).
(Continued)

*Primary Examiner* — Jared Fureman
*Assistant Examiner* — Christopher Clark
(74) *Attorney, Agent, or Firm* — Crowell & Moring LLP

(57) ABSTRACT

The invention is intended to provide a circuit breaker or a circuit breaker operating method enabling a current interruption action to be performed efficiently. A circuit breaker is characterized in that includes a fixed contact and a movable contact that comes in and goes out of contact with the fixed contact; a main circuit conductor that is electrically connected to the fixed contact and the movable contact; an operating mechanism including a mover configured by concatenating permanent magnets or magnetic materials alternately having opposite N and S magnetic polarities along the direction of motion axis of the movable contact and magnetic poles disposed to face the N and S magnetic polarities
(Continued)

of the mover and wound with windings; a current detector that detects a current flowing through the main circuit conductor; and a control device that varies the amount of a current to be supplied to the windings of the magnetic poles, depending on a current value detected by the current detector.

11 Claims, 6 Drawing Sheets

(51) Int. Cl.

| | |
|---|---|
| ***H01H 33/36*** | (2006.01) |
| ***H01H 33/59*** | (2006.01) |
| ***H01H 50/14*** | (2006.01) |
| ***H01H 50/54*** | (2006.01) |
| *H01H 3/26* | (2006.01) |

(52) U.S. Cl.
CPC ..... *H01H 33/59* (2013.01); *H01H 50/14* (2013.01); *H01H 50/54* (2013.01); *H01H 2003/268* (2013.01); *H01H 2223/002* (2013.01)

(56) References Cited

U.S. PATENT DOCUMENTS

| | | | | |
|---|---|---|---|---|
| 6,750,567 | B1 * | 6/2004 | Elli | H01H 11/0062 307/143 |
| 8,466,587 | B2 * | 6/2013 | Aoyama | H02K 41/031 310/12.24 |
| 9,035,729 | B2 * | 5/2015 | Nomura | H02H 3/02 335/177 |
| 9,312,058 | B2 * | 4/2016 | Michaelsen | H01F 7/066 |
| 9,520,699 | B2 * | 12/2016 | Urai | H01H 33/42 |
| 9,659,722 | B2 * | 5/2017 | Boffelli | H01H 9/542 |
| 9,673,005 | B2 * | 6/2017 | Urasaki | H01H 33/36 |
| 2003/0150841 | A1 * | 8/2003 | Magnussen | H02P 6/00 218/118 |
| 2004/0201943 | A1 * | 10/2004 | Takeuchi | H01H 47/226 361/139 |
| 2006/0221052 | A1 * | 10/2006 | Harada | G06F 3/016 345/156 |
| 2007/0273461 | A1 * | 11/2007 | Kang | H01F 7/066 335/6 |
| 2008/0272659 | A1 * | 11/2008 | Jeong | H01H 33/38 310/28 |
| 2011/0248579 | A1 * | 10/2011 | Aoyama | H02K 41/031 310/12.25 |
| 2015/0091677 | A1 * | 4/2015 | Urai | H01H 71/025 335/8 |
| 2015/0131207 | A1 * | 5/2015 | Urai | H01H 33/42 361/618 |
| 2015/0228417 | A1 * | 8/2015 | Maruyama | H01H 33/38 335/187 |

FOREIGN PATENT DOCUMENTS

| | | | |
|---|---|---|---|
| CN | 102214983 | A | 10/2011 |
| JP | 58-140928 | A | 8/1983 |
| JP | 5-89755 | A | 4/1993 |
| JP | 9-7468 | A | 1/1997 |
| JP | 10-308145 | A | 11/1998 |
| JP | 2002-516455 | A | 6/2002 |
| JP | 2004-88825 | A | 3/2004 |
| JP | 2004-288502 | A | 10/2004 |
| JP | 2007-523475 | A | 8/2007 |

OTHER PUBLICATIONS

International Search Report (PCT/ISA/237) dated Apr. 23, 2013 with English translation (five pages).

* cited by examiner

CIRCUIT BREAKER AND CIRCUIT BREAKER OPERATING METHOD

TECHNICAL FIELD

The present invention relates to a circuit breaker and a circuit breaker operating method and, particularly, to such one that interrupts current by operating power based on magnetic force.

BACKGROUND ART

As operating mechanisms to operate a gas circuit breaker, the followings are available: a spring operating mechanism adapted to obtain operating power by releasing the spring force held by an urged operating spring; and a pneumatic operating mechanism or a hydraulic operating mechanism adapted to obtain operating power through the use of pneumatic pressure or hydraulic pressure. However, as for operation by spring force, there are several difficulties in improving operational reliability: for instance, elastic force of a spring is not always constant; the accuracy of positioning a spring is low; and such a mechanism is complex and composed of many parts.

In regard to an operating method using pneumatic pressure or hydraulic pressure, there is a possibility that a working fluid may leak with a certain degree of change in ambient temperature and there is also a possibility that the malfunction or failure of any one of the components, if occurs, may result in failure of operation of the entire mechanism. In addition, in each of the above-mentioned operating mechanisms, its operating energy is determined in advance by the spring force held by the urged spring, hydraulic pressure, etc. and it is unable to make an operating characteristic change adaptively for each action of current interruption or during an action.

Instead of the above-mentioned operating methods which have so far been used, a technique has recently emerged for producing operating power by electricity or magnetic force, which is described in, e.g., Patent Document 1 and Patent Document 2.

In Patent Document 1, it is described that an actuation means that supplies energy for performing an open/close switching action transfers an electrical signal for driving a motor to the motor in order to achieve an electrical signal to drive an electric motor so that a position control motor operatively coupled to a movable contact and the movable contact achieve predetermined movement regularity.

In Patent Document 2, there is provided an actuator including a coil that is provided so as to be linearly movable in an axial direction between an inner permanent magnet and an outer permanent magnet and a nonmagnetic movable element, on one end of which the coil is placed, and which, when current is supplied to the coil, linearly moves in an axial direction between the inner and outer permanent magnets by repulsion electromagnetic force produced by a magnetic field generated by the inner and outer permanent magnets and a current density of the coil and there is described a circuit breaker including an insulating operating rod that is coupled to the other end of the movable element and performs a closing action and an opening action by its linear movement made by the movable element.

CITATION LIST

Patent Document

Patent Document 1: Japanese Patent Application Laid-Open (Translation of PCT Application) No. 2002-516455

Patent Document 2: Japanese Patent Application Laid-Open (Translation of PCT Application) No. 2007-523475

SUMMARY OF THE INVENTION

Technical Problem

Circuit breakers of related art including those described in the above-mentioned Patent documents are required to fulfill all kinds of current interruption duties, but perform the same current interruption action for any current, whether it is small or large; it was necessary for them to enable fulfilling all interruption duties by the same action.

Therefore, circuit breakers are over-designed with a rigid mechanical strength more than necessary so that they will not break down even when they have been operated with a maximum operating power by a prescribed number of times and have to be designed with a high-speed motion curve to fulfill all duties. They were required to have an excessive operating power more than necessary. In the case of circuit breakers having an excessive operating power more than necessary, such a concomitant problem arises that foreign matters generated from a sliding part inside a circuit breaker increase and the foreign matters generated may cause degradation in the reliability of insulation.

Thus, the present invention is intended to provide a circuit breaker or a circuit breaker operating method enabling a current interruption action to be performed efficiently.

Solution to Problem

In order to solve the above problem, a circuit breaker pertaining to the present invention is characterized by including a sealed tank in which insulating gas is sealed; a fixed contact disposed in the sealed tank and a movable contact that comes in contact with and goes out of contact with the fixed contact; an operating mechanism including a mover configured by concatenating permanent magnets or magnetic materials alternately having opposite N and S magnetic polarities along the direction of motion axis of the movable contact and magnetic poles disposed to face the N and S magnetic polarities of the mover and wound with windings; a current detector that detects a current flowing through the main circuit conductor; and a control device that varies the amount of a current to be supplied to the windings of the magnetic poles, depending on a current value detected by the current detector.

A circuit breaker operating method pertaining to the present invention is for operating a circuit breaker including a fixed contact and a movable contact that comes in contact with and goes out of contact with the fixed contact; a main circuit conductor that is electrically connected to the fixed contact and the movable contact; an operating mechanism that includes windings through which a current flows, generates operating power by magnetic force, and gives the operating power to the movable contact; and a current detector that detects a current flowing through the main circuit conductor. The circuit breaker operating method is characterized by boosting the operating power in a middle stage and later during an interruption action, if a current value detected by the current detector is larger than a threshold value.

Advantageous Effects of the Invention

According to the present invention, it is possible to provide a circuit breaker or a circuit breaker operating method enabling a current interruption action to be performed efficiently.

DESCRIPTION OF EMBODIMENTS

Figure 1A:
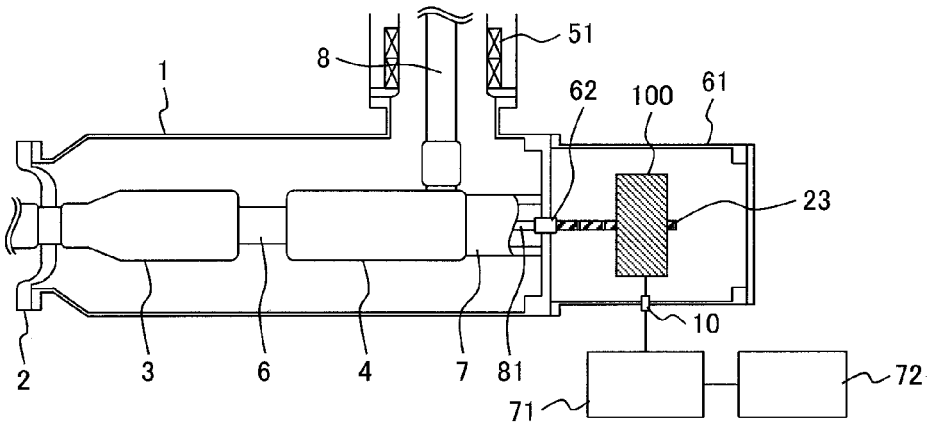
FIGS. 1A and 1B illustrate a cross-sectional view of a circuit breaker pertaining to a first embodiment.
Figure 1B:
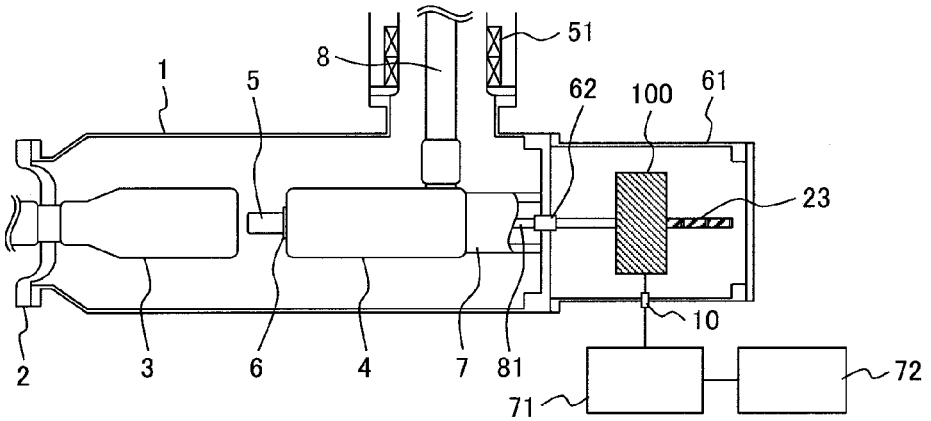

Embodiments which are preferable for carrying out the present invention will be described below with the aid of drawings. The following descriptions are only examples of embodiments and are not intended to limit the aspects of the invention to specific aspects described below. The invention can be modified in various aspects as long as having features described in the appended claims.

First Embodiment

A first embodiment is described with FIGS. 1 to 6. FIGS. 1A and 1B are configuration examples of a circuit breaker, showing an opened position and a closed position, respectively. As shown in FIGS. 1A and 1B, the circuit breaker pertaining to the present embodiment is roughly divided into an interrupter for interrupting a fault current and an operating unit for operating the interrupter.

Inside a metal enclosure 1 internally filled with $SF_6$ gas, the interrupter includes a fixed electrode (fixed contact) 3 fixed to an insulating post spacer 2 provided at an end of the metal enclosure 1, a movable electrode 4 and a movable electrode (movable contact) 6, a nozzle 5 provided between both electrodes, protruding from the movable electrode 6, an insulating post cylinder 7 which is connected to the operating unit and connected to the movable electrode 4, and a high voltage conductor 8 which is connected to the movable electrode 4 and serves as a main circuit conductor forming a part of a main circuit. Conduction and interruption of current is enabled by moving the movable electrode 6 through an operating power from the operating unit and by electrically switching.

In the surroundings of the high voltage conductor 8, a current transformer 51 is provided which acts as a current detector to detect a current flowing through the high voltage conductor 8. Inside the insulating post cylinder 7, an insulating rod 81 is disposed which is connected to the operating unit.

In the operating unit, an actuator (operating mechanism) 100 is provided inside an operating unit case 61 provided adjacent to the metal enclosure 1 and a mover 23 that moves linearly is disposed inside the actuator 100. The mover 23 is coupled to the insulating rod 81 through a linear seal portion 62 which is provided to enable driving, while keeping the metal enclosure 1 air tight. In turn, the insulating rod 81 is coupled to the movable electrode 6. That is, the movable electrode 6 in the interrupter can be moved through the motion of the mover 23.

The actuator 100 is electrically connected to a power supply unit 71 through a sealed terminal 10 with insulating gas sealed therein, which is provided at the surface of the metal enclosure 1. In turn, the power supply unit 71 is further connected to a control unit 72 and configured to be able to receive a signal from the control unit 72. To the control unit 72, a current value detected by the current transformer 51 is to be input. The power supply unit 71 and the control unit 72 act as a control device that changes an amount of current and a phase to be supplied to windings 41 of the actuator 100 which will be described below, depending on a current value detected by the current transformer 51.

The structure of the interrupter is described with FIGS. 2 to 5. The actuator 100 is configured such that, inside a stator 14 comprised of two sets of a first magnetic pole 11, a second magnetic pole 12 disposed in a position opposite to the first magnetic pole 11, a magnetic material 13 joining the first magnetic pole 11 and the second magnetic pole 12, and windings 41 provided on the outer surfaces of the first magnetic pole 11 and the second magnetic pole 12, a mover 23 comprised of a sequence of permanent magnets 21 and magnets fixing members 22 holding the permanent magnets 21 fixed therebetween is disposed in a position where both surfaces of the permanent magnets face toward the first magnetic pole 11 and the second magnetic pole 12 across a gap. The permanent magnets 21 are magnetized in a Y-axis direction (vertical direction in FIG. 2) such that every two adjacent magnets are magnetized to have opposite magnetic polarities.

The magnets fixing members 22 are preferably made of a nonmagnetic material such as, e.g., but not limited to, nonmagnetic stainless alloy, aluminum alloy, or resin material. The actuator 100 is fitted with a mechanical part to keep a gap between the permanent magnets 21 and the first magnetic pole 11 as well as the second magnetic pole 12. As the mechanical part, for example, a linear guide, a roller bearing, a cam follower, a thrust bearing, or the like is preferable; but this is non-limiting, if it can keep the gap between the permanent magnets 21 and the first magnetic pole 11 as well as the second magnetic pole 12.

In general, attractive force (force in the Y-axis direction) is generated between the permanent magnets 21 and the first magnetic pole 11 as well as the second magnetic pole 12. However, in the present structure, attractive force generated between the permanent magnets 21 and the first magnetic pole 11 and attractive force generated between the permanent magnets 21 and the second magnetic pole 12 cancel each other out because of opposite directions in which these forces are generated and the attractive forces become small. Thus, a mechanism for holding the mover 23 can be made simple and the mass of a movable body including the mover 23 can be reduced. Because the mass of the movable body can be reduced, high acceleration driving and high response driving can be achieved. Since the stator 14 and the permanent magnets 21 are relatively driven in a Z-axis direction (horizontal direction in FIG. 2), the mover 23 including the permanent magnets 21 is driven in the Z-axis direction by fixing the stator 14. Conversely, it is also possible to move the stator 14 in the Z-axis direction with the mover 23 keeping fixed. In this case, the mover and the stator invert. Definitely, force that is generated is a relative force created between the both.

For driving, by allowing a current to flow through the wirings 41, a magnetic field is generated to make it possible to generate thrust according to a relative position between the stator 14 and the permanent magnets 21. Also, the magnitude and direction of the thrust can be adjusted by controlling the positional relation between the stator 14 and the permanent magnets 21 and the phase and magnitude of a current to be fed. The motion of the mover 23 is controlled as follows. When either of an opening signal and a closing signal is input to the control unit 72, a current depending on the input signal is allowed to flow from the power supply unit 71 into the actuator 100 and the electric signal is converted to the force to drive the mover 23 in the actuator 100.

Figure 2:
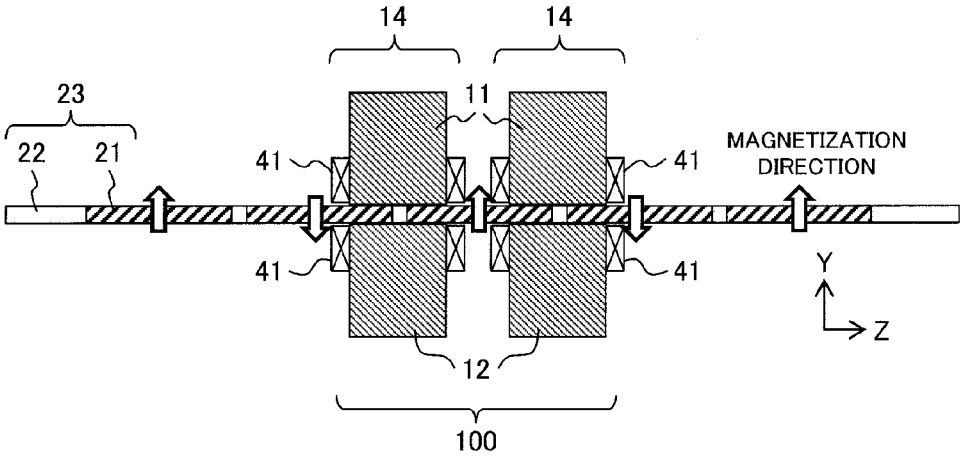
FIG. 2 is a diagram depicting one unit in an operating mechanism pertaining to the first embodiment.
Figure 3:
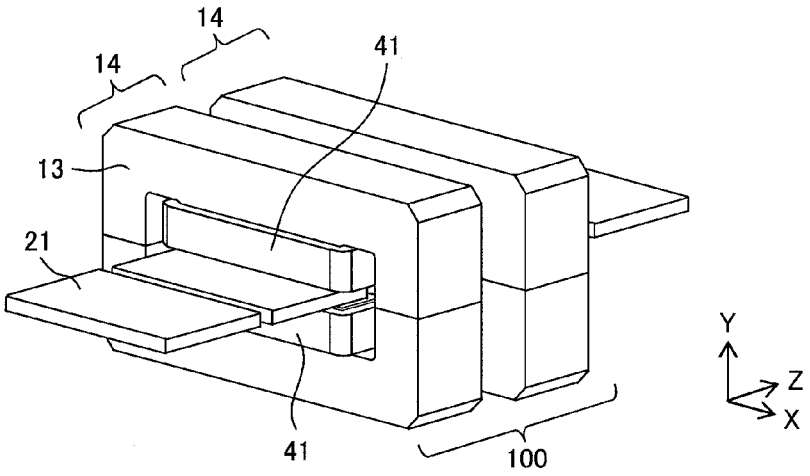
FIG. 3 is a perspective view for explaining one unit of an actuator pertaining to the first embodiment.
Figure 4:
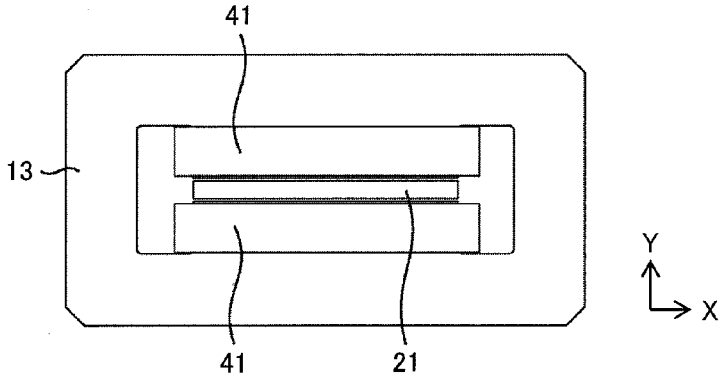
FIG. 4 is a front view of FIG. 3.
Figure 5:
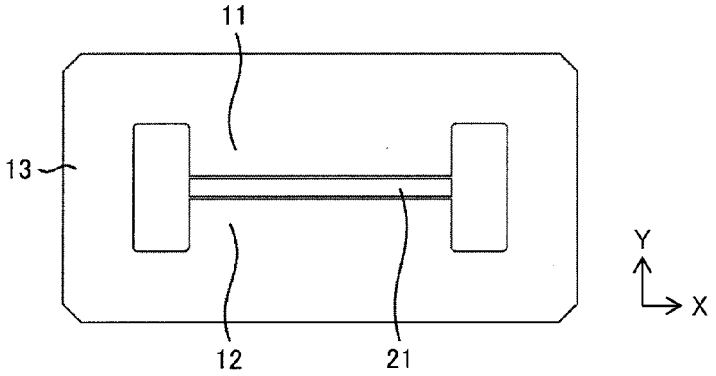
FIG. 5 is a diagram depicting the same in FIG. 4 from which the wirings were removed.

FIG. 3 shows a perspective view of the structure of one unit of the actuator 100 described above. As shown in FIGS. 3 to 5, the actuator is configured so that the mover including the permanent magnets 21 will move in the Z-axis direction relative to the stator 14 comprised of the first magnetic pole 11, the second magnetic pole 12, the magnetic material 13 joining the first magnetic pole 11 and the second magnetic pole 12, and the windings 41. As shown in FIG. 2, the mover 23 has a plurality of permanent magnets 21 that are magnetized to alternately have opposite N and S magnetic polarities and mechanically concatenated by the magnets fixing members or the like along the direction of motion axis of the movable contact. The first magnetic pole 11 and the second magnetic pole 12 of the stator 14 are disposed to face toward these N and S magnetic polarities of the mover. Thrust in the Z-axis direction is continuously produced by allowing an AC current to flow through the windings 41 and the driving distance can be lengthened according to the length of the mover 23.

In the present embodiment, the magnetic material 13 joining the first magnetic pole 11 and the second magnetic pole 12 splits in the Y-axis direction. This facilitates workability for the windings 41. Moreover, this enables shifting the first magnetic pole and the second magnetic pole in the Z-axis direction for adjustment. In a case where the first magnetic pole and the second magnetic pole have been shifted and placed, it is possible to increase thrust by changing the magnetization directions of the permanent magnets.

Besides, intrinsically, driving the mover in the Z-axis direction is possible without using the upper magnetic pole; it is concretely conceivable to make such a modification among others. However, like the present embodiment, by configuring the actuator such that the mover is sandwiched across a gap between the first and second magnetic poles, the attractive forces between the permanent magnets and each magnetic pole are small and the mover, even when being driven linearly, would sway very little in directions (X-axis and Y-axis directions) perpendicular to the driving direction (Z-axis direction). Considering application to a circuit breaker, even when the mover conveying the operating power goes through the linear seal portion 62, the linear seal portion 62 would deform little and, thus, the mechanical load exerted on the seal portion is reduced.

Because this leads to preventing not only poor sliding motion of the driven mover through the linear seal portion 62, but also a tilted contact of the movable electrode 6, the structure can be resistant to galling of a contact sliding portion and the generation of minute metal foreign matters from the electrodes. Galling may result in a malfunction of current interruption and conduction and metal foreign matters may result in an insulation fault due to deteriorated insulation performance. Also, it is possible to reduce the leakage of $SF_6$ gas in the gas circuit breaker, which leaks out as a result of seal deformation. In this way, from various perspectives, it is possible to improve the reliability of the circuit breaker.

FIG. 4 is a front view of FIG. 3. FIG. 5 is a diagram in which the windings 41 were removed from FIG. 4 to facilitate understanding of a relation between the first magnetic pole 11, the second magnetic pole 12, and the magnetic material 13 joining them. As seen from both of the figures, the windings 41 are wound on each of the first magnetic pole 11 and the second magnetic pole 12 and disposed so that the permanent magnets 21 are sandwiched between them. Because the windings 41 and the permanent magnets 21 are disposed to face each other, magnetic fluxes generated in the windings 41 efficiently act on the permanent magnets 21. Accordingly, the actuator can be made in smaller size and lighter weight.

Furthermore, a magnetic circuit is closed by the first magnetic pole 11, the second magnetic pole 12, and the magnetic material 13 joining the first and second magnetic poles and the path of the magnetic circuit can be shortened. Thereby, it is possible to generate large thrust. Because the magnetic material surrounds the permanent magnets 21, leakage magnetic fluxes that leak out can be reduced and an adverse effect on peripheral equipment and machines can be reduced.

Figure 6:
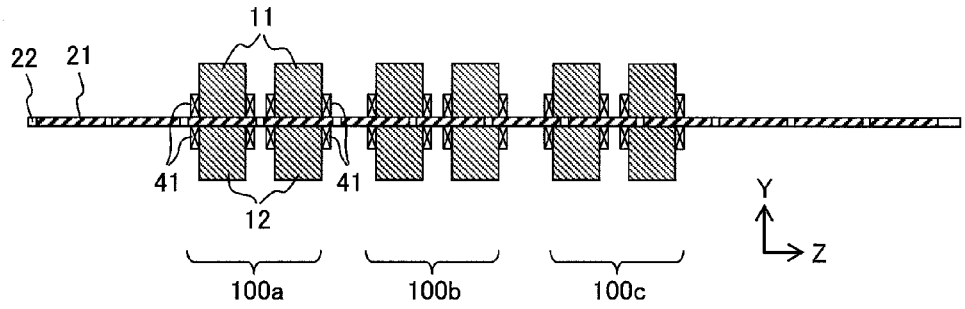
FIG. 6 is a diagram to explain actuators pertaining to the first embodiment.
Figure 7:
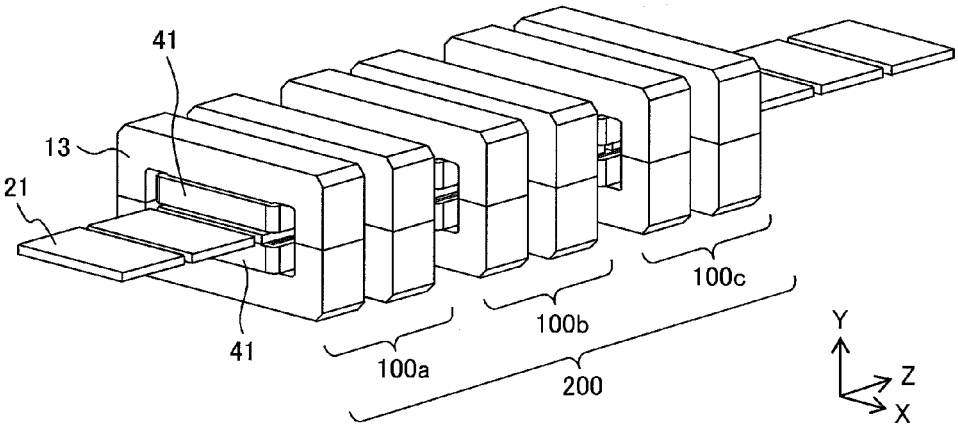
FIG. 7 is a perspective view for explaining the actuators pertaining to the first embodiment.

FIG. 6 shows a structure in which three units of actuators 100*a*, 100*b*, 100*c* are arranged side by side in the Z-axis direction (the direction in which the movable electrode 6 moves).

One unit of an actuator is as described above. The three units of actuators are disposed in positions where electrical phases are shifted from each other with respect to the permanent magnets 21. Given one stator per unit, three units of actuators are comprised of three stators. Likewise, given N stators per unit, three units of actuators are comprised of 3×N (a multiple of 3) stators.

In the present embodiment, in particular, relative to an actuator 100*a*, the electrical phase of the actuator 100*b* is shifted by 120° (or 60°) and the electrical phase of the actuator 100*c* is shifted by 240° (or 120°). In this arrangement of the actuators, when a three-phase AC current is allowed to flow through the wirings 41 of each actuator, the same operation as the operation of a three-phase linear motor can be implemented.

By using three units of actuators, which are regarded as three independent actuators, it is possible to adjust thrust for each actuator by individually controlling the current to be fed to each actuator. To the windings of the respective actuators, currents of different magnitudes and phases from one another can be fed from the control device.

In one way, it is conceivable to feed currents of three phases of U, V, and W separately which are supplied from a single AC power supply. In this case, it is not necessary to provide a plurality of power supplies and the structure would be simple. Also, in this case, as regards the above-mentioned sealed terminal, there are options as follows: providing 3×N sealed terminals and sharing a sealed terminal with actuators into which a same current is allowed to flow.

In the present structure, constant thrust can be generated independently of a positional relation between the permanent magnets 21 and a structure 200 using a plurality of actuators. Moreover, it is also possible to generate a braking force (damping force) by control, regenerate electric power created by braking, and make efficient use of electric energy.

A current interruption action of the circuit breaker configured as described above is described. When a fault current flows upon the occurrence of an abnormal event in an electrical system, the circuit breaker is opened, detecting the fault current. As a result, the circuit breaker must make a transition from the closed position shown in FIG. 1(*a*) to the opened position shown in FIG. 1(*b*). At this time, by making $SF_6$ gas having an arc quenching ability blow against an arc generated in the interrupter, particularly, between electrodes, the arc plasma is extinguished and the fault current is interrupted.

Figure 8:
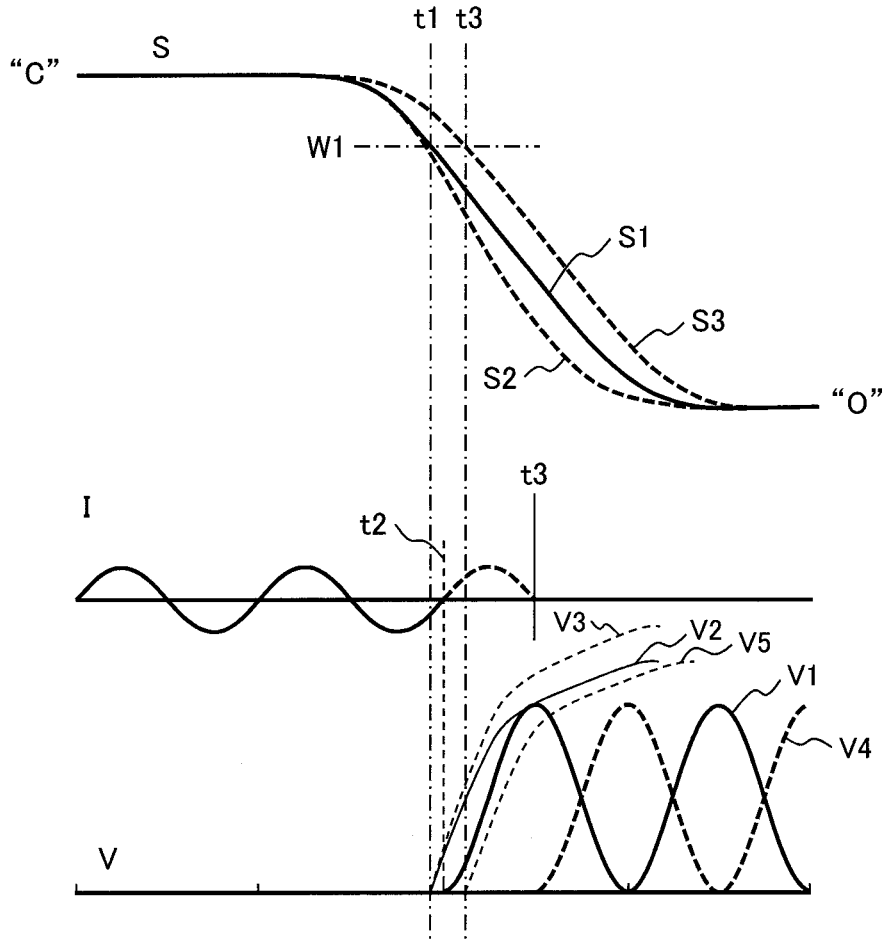
FIG. 8 is a curve diagram to explain an interruption characteristic in a small current mode or a usual mode.

FIG. 8 represents, in time series, the moving speed of the movable electrode 6, an interruption current which should be interrupted, a voltage between electrodes, and a withstand voltage between electrodes, when a current is interrupted.

In the present embodiment, a plurality of independent actuators are provided, as described above, and an acceleration/deceleration pattern of an open/close switching action can be controlled in various ways even during driving. In such a case, it is possible to take in a current waveform and control the action accordingly.

A current waveform as presented in FIG. 8 can be detected by the current transformer 51 for detecting a current and, by inputting the detected current waveform to the control unit 72, an optimal action fit for an interruption current which should be interrupted can be implemented. An example of a case where the action is controlled depending on the interruption current which should be interrupted will be described below.

The following will describe a current interruption method in which the action is varied depending on the magnitude of a current flowing through the high voltage conductor 8. A current flowing through the high voltage conductor 8 is measured by the current transformer 51 disposed in the surroundings of the high voltage conductor 8. A measured current value is sent to the control unit 72 of the operating mechanism. The control unit 72 internally holds two threshold values. One is an upper threshold value (e.g., 4000 A) for judging it as a large current mode if the current exceeds the threshold value and the other is a lower threshold value (e.g., 200 A) for judging it as a small current mode if the current is less than the threshold value.

The control unit 72 internally compares a current value measured by the current transformer 51 with the above two threshold values. As a result of the comparison, if the current value is more than the upper threshold value, the control unit judges it as a large current mode; if the current value is less than the lower threshold value, the control unit judges it as a small current model if the current value is intermediate between both of the threshold values, the control unit judges it as a usual mode. Depending on a result of the judgment, a signal that is sent from the control unit 72 to the power supply unit 71 changes as follows.

In the case of a large current mode judged, to the actuators 100*a*, 100*b*, 100*c*, a current signal is sent to generate driving force for a middle or final period of an interruption action (in a middle stage and later during an interruption action) so that the operating mechanisms can resist excessive reaction force of manipulation exerted on them.

In the case of a small current mode judged, the control unit 72 sends the power supply unit 71 a current signal to generate driving force for an initial period of an interruption action (before a middle stage during an interruption action) so that a withstand voltage between electrodes can be increased early. In the case of a usual mode judged, because interruption in a special situation like any of the above cases is regarded as inapplicable, the control unit 72 sends the power supply unit 71 a current pattern signal to feed a current signal to implement an ordinary interruption to the actuators 100*a*, 100*b*, 100*c*.

Upon receiving a signal from the control unit 72, the power supply unit 71 feeds a current in accordance with the signal to the actuators 100*a*, 100*b*, 100*c*.

Reason why such an operation as described above is performed is described below.

First, a description is provided for an ordinary interruption action (usual mode). A marking "S" in the figure denotes the interrupter action and, in a usual mode, moving along a bold curve S1 from a closed position (C) to an opened position (O) takes place. When the movable electrode 6 in the interrupter has moved up to a sliding distance W1 which has been set in advance, the electrode comes to an opened position at time t1.

"I" is the waveform of an interruption current, which should be interrupted, detected by the current transformer 51 and the current is interrupted when it crosses a zero point at time t2 after the opening. In a usual mode, a withstand voltage V2 between electrodes does not become lower than a voltage V1 between electrodes. That is, the action in this case is regarded as basic.

Then, a description is provided for an action in a case of interrupting a small current (small current mode). In this case, what should be interrupted is a phase advance load such as a power transmission line opened at a remote end and a current value is small in or below a range from several tens to several hundred amperes. Because the current is small, its interruption is easy and the current is interrupted at a zero point at time t2 which first appears after the time t1 of opening.

Here, when a phase advance load is interrupted, a voltage equivalent to a high value of a power supply voltage waveform remains at the load end and, consequently, a voltage that is twice as high as a power supply voltage is applied between electrodes. At the same time, the withstand voltage V2 between electrodes in the interrupter increases over time. That is, at this time, the voltage V1 between electrodes and the withstand voltage V2 between electrodes compete and, if the voltage V1 between electrodes becomes higher than the withstand voltage V2 between electrodes, a dielectric breakdown occurs between electrodes.

Because an excessively surging overvoltage is accompanied by a dielectric breakdown, it must be avoided that the withstand voltage V2 between electrodes becomes lower than the voltage V1 between electrodes. Therefore, in the case of a small current mode judged, such a fast interruption action as described above should be performed. In particular, by rapidly feeding a large current to one of the actuators 100*a*, 100*b*, 100*c*, namely, an actuator 100*a* that generates driving force for an initial period of the action (that is, an actuator nearest to the fixed electrode with respect to the moving direction of the movable electrode 6), it is possible to drive the mover by a fast interruption action S2 which is faster than the ordinary action characteristic curve S1 in a usual mode in an action characteristic graph shown in FIG. 9.

That is, this can increase the withstand voltage (V3) between electrodes earlier than V2. In this way, in the case of a small current mode, because it is regarded that a phase advance load should be interrupted, a dielectric breakdown between electrodes is avoided by increasing the driving force for an initial period of an action so that the withstand voltage between electrodes changes along V3 and always keeps higher than the voltage V1 between electrodes. In the present embodiment, because an increase in the operating energy occurs only during an initial period, it is possible to minimize necessary energy increase.

Figure 9:
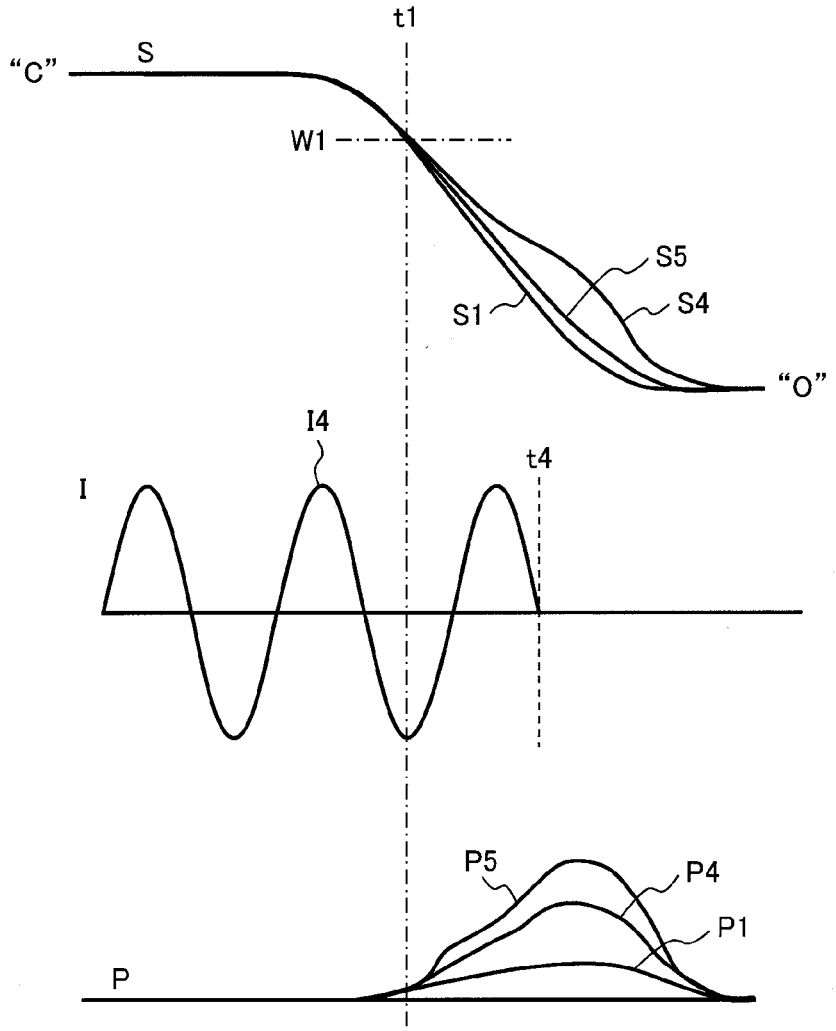
FIG. 9 is a curve diagram representing an interruption characteristic in a large current mode.

Subsequently, a description is provided for an action in a case of interrupting a large current (large current mode). FIG. 9 is a time-series graph representing an interruption phenomenon in a case of interrupting a large current such as a short-circuit current. An interrupter action characteristic is denoted by "S" and an interruption current which should be interrupted is denoted by "I". The interrupter in the present embodiment is provided with a gas compression mechanism comprised of a puffer cylinder and a stationary piston for making the arc quenching gas blow against an arc at an interruption point, though depiction thereof is omitted. Pressure of the gas compression mechanism is denoted by "P" here.

Action characteristic S1 and blowing pressure P1 denote the characteristics in an ordinary mode or a small current mode. Under these modes, an increase in the pressure P1 is relatively low and its effect on the action characteristic is small. At this time, action characteristics are similar to S1 and S2 (the case of intensively fast interruption) in FIGS. 8 and 9.

On the other hand, if an attempt is made to apply the same operation also for interrupting a large current, an interruption action characteristic is represented by a curve S4 and blowing pressure P is represented by a waveform denoted by P4, because an interruption current I4 which should be interrupted is large. The reason for this is that, when a large current is interrupted, pressure rises to a greater extent due to arc energy and the pressure generated in the compression mechanism acts as excessive reaction force of manipulation that is exerted on the operating mechanisms. In consequence, the reaction force of manipulation becomes large, the motion of the movable electrode 4 stagnates as indicated by the action characteristic curve S4, and, in some situations, a backset may occur in the action characteristic. Hence, such characteristic is unfavorable for ensuring stable interruption performance.

To avoid such a situation, a current passing though the circuit breaker is monitored by the current transformer 51 even when interrupting a large current, as is done in the case of interrupting a small current, described previously. In the case of a large current that is likely to result in stagnation in the action characteristic, control is implemented to feed a large current to an actuator 100*b* or/and an actuator 100*c* which generate driving force for a middle period or final period of an interruption action, thus boosting the operating energy for a middle period and later of an interrupter action in order to alleviate stagnation in the action characteristic.

This way of operation makes it possible that the interruption action with alleviated stagnation as indicated by S5 not S4 is performed and, in consequence, the blowing pressure makes a further increase as indicated by P5. In the present embodiment, because an increase in the operating energy occurs only during a middle or final period, it is possible to minimize necessary energy increase.

As control in the case of a small current mode, along with those described above, it is also possible to suppress the application of operating energy to the actuator 100*a* to reduce the driving force for an initial period conversely, thus making the driving characteristic slower as indicated by S3.

In particular, a time of opening t3 is set later than the zero-point time t2. Because the time of opening t3 is later than the zero-point time t2 that can be a first zero-cross point, the current is not interrupted at the zero-point time t2 and the current zero delays to a next zero-point time t4.

Control is implemented to decrease the operating power for the actuator 100*a* nearest to the fixed electrode with respect to the moving direction to fulfill the relation that the time of opening t3 is later than the zero-point time t2 that can be a first zero-cross point. In consequence, while the withstand voltage between electrodes decreases as indicated by the curve of a withstand voltage V5, as the interruption speed decreases, the waveform of the voltage generated also shifts as indicated by V4. Eventually, it can be avoided that the withstand voltage V5 becomes lower than the voltage V4 between electrodes.

To make a comparison between time of opening and zero-point time in this way, the control unit 72 is adapted to have a function of detecting a phase of a current for calculating current zero times, in addition to monitoring the amplitude of an interruption current I which should be interrupted.

Besides, in order to improve the accuracy of predicting current zero times, it is further effective to monitor a voltage waveform measured at the same time by a voltage transformer which is not shown. In a case where such control as an alternative is performed, it is possible to attain a purpose only by making an interruption action slower and, therefore, this has an advantage that no increase is made in necessary electric power without need for feeding a current more than necessary, as is done in the above-described cases.

According to the present embodiment, the control device is configured to vary the amount of a current to be supplied to the windings of the actuators, depending on a current value detected by the current transformer, efficient operation becomes feasible, and total operating energy can be reduced. That is, because an open/close switching action and an acceleration/deceleration pattern can be determined optionally, interruptions in diverse modes can be implemented with minimum energy depending on the current to be interrupted.

Additionally, it is also possible to generate braking force for deceleration of actuators and this can eliminate the need for a braking device such as a dash pot in a spring operating mechanism and a hydraulic operating mechanism which have so far been commonly used; a smaller circuit breaker can be realized.

Furthermore, advantageous effects as noted above are accomplished by using a mechanism with fewer components that generates operating power by magnetic force and reliability and maintainability are improved.

Examples of efficient operations are set forth as follows: feeding operating energy intensively for an initial period of an action to cope with a high voltage interruption duty which requires a fast operation; and feeding operating energy intensively for a final period of interruption when the blowing pressure rises, when interrupting a large current, which requires large operating power. These ways of operation can be used together; besides, it goes without saying that, even if either of these is only implemented, an efficient interruption action can be achieved.

Second Embodiment

Figure 10:
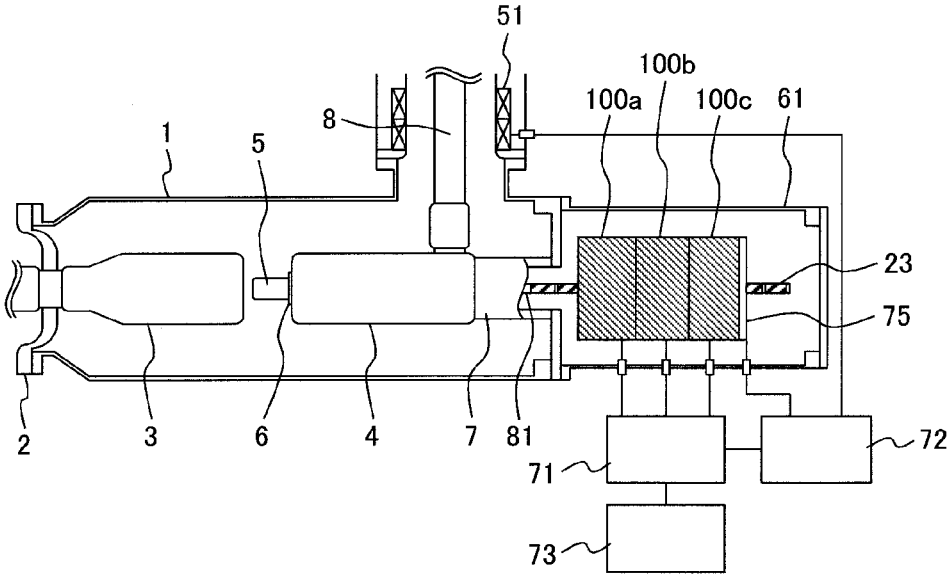
FIG. 10 is a cross-sectional view of a circuit breaker pertaining to a second embodiment.

A second embodiment is described with FIG. 10. In the present embodiment, a power storage unit 73 is provided which includes power storage devices such as a capacitor and a charger so that interruption operation can be performed even if supply of the power source for operation has been disconnected.

In a case where electrical operation is performed using electric energy, as described herein, unless supply of electricity from the power supply or the charger stops, operation can be performed and the operating mechanism is capable of position keeping. Thus, by configuring the circuit breaker as in the present embodiment, it will become possible to continue to keep a closed position or an opened position in the interrupter even in the event that power outage or the like causes loss of the position keeping ability of the electromagnetically operating mechanism.

Although an instance in which permanent magnets are used was described in each of the foregoing embodiments, the mover can be configured with magnetic materials arranged therein instead of the permanent magnets. The magnetic materials refer to materials that are affected by attractive force from a magnet and typical materials as such are iron, silicon steel sheet, etc.

In each of the foregoing embodiments, the multiple actuators are placed in a linear arrangement and currents to be fed to them can be controlled individually, as individual actuators. That is, control operation includes acquiring information on a current passing through the interrupter immediately before or during an interruption action, judging an interruption condition, and driving the operating mechanisms to attain an action characteristic fit for the interruption condition. Thereby, control can be implemented to attain optimal action characteristics as follows: the withstand voltage between electrodes is higher than the voltage between electrodes when a small current is interrupted; and no stagnation occurs in the action characteristic and a maximum blowing pressure is gained when a large current is interrupted.

In each of the foregoing embodiments, an instance is given in which the interrupter and the operating unit are put in separate gas chambers and driving the operating mechanism is performed via the linear seal portion 62. However, the interrupter and the operating unit may be put in a single gas chamber and both of the interrupter and the operating unit may be filled with the same high-pressure $SF_6$ gas.

In the case in which the interrupter and the operating unit are put in separate gas chambers as shown in FIG. 1, the interrupter is filled with high-pressure $SF_6$ gas. However, one case in which the operating unit case 61 of the operating unit is sealed from outside (air) and another case in which it is not sealed are conceivable.

If the operating unit case 61 is sealed, its internal space may be filled with dry air of atmospheric pressure, nitrogen, or insulating gas such as $SF_6$ gas. If the operating unit is sealed, it is not likely to be affected by external environment and it is possible to eliminate causes of deteriorating performance such as incursion of humid, rainwater, insects, etc.; accordingly, the operating unit with high reliability can be provided.

However, if the operating unit is sealed, it would be hard to inspect its internal components. In the event that a fault has occurred in the operating unit, what caused an internal abnormal event would be hard to detect. Also, simple internal maintenance and inspection would be hard to be performed. If priority is given to the easiness of such internal inspection, the operating unit case 1 does not need to be sealed, though reliability might be deteriorated by external influence.

In each of the foregoing embodiments, an instance is given in which an actuator 100 is comprised of two stators 14 and a current with the same waveform (the same in terms of magnitude, phase, and frequency) is assumed to be fed to these stators. However, the number of stators to which a current with the same waveform is fed is not limited to two. Even one stator can be driven as an operating mechanism of the circuit breaker or it is also possible to give thrust proportional to the number of stators by increasing the number to three or more.

REFERENCE SIGNS LIST

1 . . . metal enclosure,
2 . . . insulating post spacer,
3 . . . fixed electrode,
4 . . . movable electrode,
5 . . . nozzle,
6 . . . movable electrode
7 . . . insulating post cylinder
8 . . . high voltage conductor
11 . . . first magnetic pole
12 . . . second magnetic pole
13 . . . magnetic material
14 . . . stator
21 . . . permanent magnets
22 . . . magnets fixing members
23 . . . mover
24 . . . mover coupling part
30 . . . fixing plate
31 . . . spacer
41 . . . windings
51 . . . current transformer
61 . . . operating unit case
62 . . . linear seal portion
71 . . . power supply unit
72 . . . control unit
73 . . . power storage unit
81 . . . insulating rod
100 . . . actuator

The invention claimed is:

1. A circuit breaker comprising:

a sealed tank in which insulating gas is sealed;

a fixed contact disposed in the sealed tank and a movable contact that comes in contact with and goes out of contact with the fixed contact;

a main circuit conductor that is electrically connected to the fixed contact and the movable contact;

an operating mechanism including a mover configured by concatenating permanent magnets or magnetic materials alternately having opposite N and S magnetic polarities along a direction of motion axis of the movable contact and magnetic poles disposed to face the N and S magnetic polarities of the mover and wound with windings;

a current detector that detects a current flowing through the main circuit conductor; and a control device that varies the amount of a current to be supplied to the windings of the magnetic poles, depending on a current value detected by the current detector.

2. The circuit breaker according to claim 1, wherein, the operating mechanism includes a plurality of operating mechanisms arranged side by side in a direction in which the movable contact moves and currents of different magnitudes and/or phases from one another are fed from the control device to the windings of the respective operating mechanisms, depending on the detected current value.

3. The circuit breaker according to claim 2, wherein, a number N of the operating mechanisms, where N is a multiple of 3, are arranged side by side in the direction in which the movable contact moves and a current of any phase of U, V, and W phases is fed to the windings of each operating mechanism.

4. The circuit breaker according to claim 3, wherein, a number N of sealed terminals, where N is a multiple of 3, with insulating gas sealed therein are provided at the surface of the sealed tank; and the respective windings of the number N of operating mechanisms, where N is a multiple of 3, are respectively connected to different ones of the sealed terminals and the respective sealed terminals are connected to the control device.

5. The circuit breaker according to claim 1, wherein, the control device includes a control unit to which a current value is input from the current detector and a power supply unit that feeds a current to the windings; and the control unit outputs a current pattern signal of a current to be fed to the windings to the power supply unit.

6. The circuit breaker according to claim 5, wherein, the power supply unit is further connected to a power storage unit.

7. The circuit breaker according to claim 1, wherein, the control device further has a function of detecting a phase of a current flowing through the main circuit conductor.

8. A circuit breaker operating method for operating a circuit breaker comprising:

a sealed tank in which insulating gas is sealed;

a fixed contact disposed in the sealed tank and a movable contact that comes in contact with and goes out of contact with the fixed contact;

a main circuit conductor that is electrically connected to the fixed contact and the movable contact;

an operating mechanism that comprises windings through which a current flows, generates operating power by magnetic force produced by the windings, and gives the operating power to the movable contact; and a current detector that detects a current flowing through the main circuit conductor, the circuit breaker operating method characterized by boosting the operating power in a middle stage and later during an interruption action, if a current value detected by the current detector is larger than a threshold value.

9. A circuit breaker operating method for operating a circuit breaker comprising:

a sealed tank in which insulating gas is sealed;

a fixed contact disposed in the sealed tank and a movable contact that comes in contact with and goes out of contact with the fixed contact;

a main circuit conductor that is electrically connected to the fixed contact and the movable contact;

an operating mechanism that comprises windings through which a current flows, generates operating power by magnetic force produced by the windings, and gives the operating power to the movable contact; and a current detector that detects a current flowing through the main circuit conductor, the circuit breaker operating method characterized by boosting the operating power before a middle stage during an interruption action, if a current value detected by the current detector is smaller than a threshold value.

10. A circuit breaker operating method for operating a circuit breaker comprising:

a sealed tank in which insulating gas is sealed;

a fixed contact disposed in the sealed tank and a movable contact that comes in contact with and goes out of contact with the fixed contact;

a main circuit conductor that is electrically connected to the fixed contact and the movable contact;

an operating mechanism that comprises windings through which a current flows, generates operating power by magnetic force produced by the windings, and gives the operating power to the movable contact; and a current detector that detects a current flowing through the main circuit conductor, the circuit breaker operating method characterized by setting a time to open the movable contact later than a zero-point time that can be a first zero-cross point during an interruption action, if a current value detected by the current detector is smaller than a threshold value.

11. The circuit breaker operating method according to claim 8, further comprising:

boosting the operating power before a middle stage during an interruption action, if a current value detected by the current detector is smaller than a threshold value.

* * * * *